US006977637B2

(12) United States Patent
Ikeda et al.

(10) Patent No.: US 6,977,637 B2
(45) Date of Patent: Dec. 20, 2005

(54) METHOD OF DRIVING LIQUID CRYSTAL DISPLAY

(75) Inventors: Naoyasu Ikeda, Tokyo (JP); Hideki Asada, Tokyo (JP)

(73) Assignee: NEC Corporation, Tokyo (JP)

( * ) Notice: Subject to any disclaimer, the term of this patent is extended or adjusted under 35 U.S.C. 154(b) by 466 days.

(21) Appl. No.: 10/137,439

(22) Filed: May 3, 2002

(65) Prior Publication Data

US 2002/0186191 A1 Dec. 12, 2002

(30) Foreign Application Priority Data

Jun. 6, 2001 (JP) ..... 2001-170693

(51) Int. Cl.[7] ..... G09G 3/36; G09G 5/00
(52) U.S. Cl. ..... 345/94; 345/208
(58) Field of Search ..... 345/76–83, 87–100, 345/208, 211; 455/556.1, 556.2, 574, 566; G09G 3/30, G09G 3/34, 3/36

(56) References Cited

U.S. PATENT DOCUMENTS 6,522,319 B1 * 2/2003 Yamazaki ..... 345/103
6,771,240 B2 * 8/2004 Inoue et al. ..... 345/87

FOREIGN PATENT DOCUMENTS

| | | | |
|---|---|---|---|
| JP | 04-078823 | 3/1992 | |
| JP | 07-230077 | 8/1995 | |
| JP | 10-187105 | 7/1998 | |
| JP | 10-240195 | 9/1998 | |
| JP | 2000112435 A * | 4/2000 | ..... G09G 3/36 |
| WO | 99/40561 | 8/1999 | |

* cited by examiner

*Primary Examiner*—Alexander Eisen
(74) *Attorney, Agent, or Firm*—Young & Thompson

(57) ABSTRACT

In a first frame immediately after LCD recognizes a start of a low electric power consumption mode, within a region in which an indication is required, signals VDn and VCOM are supplied to data lines and a common electrode, respectively. In a region in which the indication is not required, the signals VDn and VCOM are fixed to the low level, thus, polarities of the signals VDn and VCOM are not inverted even between gate lines adjacent to each other, in a portion from a next frame to an x-th frame. In each frame, within the region in which the indication is required, VDn and VCOM are supplied to the data lines and the common electrode, respectively. In the region in which the indication is not required, the signals VDn and VCOM are fixed to the low level, in each frame, moreover, an output of a selection signal to the gate line is stopped.

12 Claims, 17 Drawing Sheets

METHOD OF DRIVING LIQUID CRYSTAL DISPLAY

BACKGROUND OF THE INVENTION

1. Field of the Invention

The present invention relates to a method of driving a liquid crystal display (hereafter, referred to as LCD) suitable for a portable telephone and a portable information terminal, in which a battery is used as a drive power supply, and the like, and more particularly to a method of driving LCD so as to reduce an electric power consumption.

2. Description of the Related Art

Since the LCD is small and light and has lower electric power consumption, it is widely used in a display of a portable terminal which is represented by a portable telephone driven by a battery. For example, in the portable telephone, the LCD is used to indicate a telephone number and text of an electric mail. However, an indication of the longest time in using the portable telephone is the indication at a wait state while a call is not received. The electric power consumption in this period has enormous influence on an operation time of the portable telephone. FIG. 18 is a schematic view showing an example of the indication at the wait state. In a case of an actual portable telephone, at the wait state, a time and a calendar are indicated in general, as shown in FIG. 18. Moreover, it is necessary to indicate a remaining amount of a battery for indicating whether the portable telephone can be used or not, and also indicate a reception condition of an electric wave. Thus, the indication can not be put off even in a period except the call period (in a period at the wait state). At this time, the electric power is always consumed in the LCD. Hence, this causes the large reduction in the operation time of the portable telephone, especially, the callable time.

Even in a case of another portable terminal, it is necessary to operate the LCD if operating a calendar function and a clock function. Similarly to the portable telephone, the electric power is always consumed in the LCD. This causes the operation time of the portable terminal to be largely reduced.

In order to solve such problems, for example, Japanese Laid Open Patent Application (JP-A-Heisei, 7-230077) discloses a driving method of reducing a gradation indication voltage at a wait state. FIG. 19 is a block diagram showing the configuration of LCD similar to that disclosed in Japanese Laid Open Patent Application (JP-A-Heisei, 7-230077). This LCD is provided with a signal driver circuit 33, a liquid crystal matrix panel 34, a scanning driver circuit 35, a light source 36, a display control circuit 37, a voltage controller 38 and an interface circuit 39. The voltage controller 38 is the circuit for generating a plurality of gradation indication voltages. The signal driver circuit 33 generates a signal voltage of an amplitude corresponding to a gradation for an image data inputted through the interface circuit 39, by using the gradation indication voltage generated by the voltage controller 38, and then applies it to the liquid crystal matrix panel 34.

In the conventional LCD having the above-mentioned configuration, if the wait status is instructed through the interface circuit 39, the voltage controller 38 reduces the voltage of the gradation indication voltage to thereby reduce the electric power consumption.

In the case of the above-mentioned LCD to reduce the electric power consumption, it is possible to check the remaining amount of the battery, the current time, the reception condition of the electric wave and the like because wait state indication is displayed. However, an effective value of a voltage applied to a liquid crystal pixel is dropped. Thus, this results in a problem that the indication becomes extremely invisible when a multiple-gradation indication is displayed.

The present invention is proposed in view of the above mentioned problems. It is therefore an object of the present invention to provide a method of driving LCD, which can reduce an electric power consumption at a wait state without any deterioration in image quality.

SUMMARY OF THE INVENTION

A method of driving a liquid crystal display according to the present invention comprising the steps of: applying a voltage corresponding to an image data to pixel electrodes in a predetermined first region of a liquid crystal display panel when scanning the first region for one frame period, and fixing a potential of pixel electrodes in a predetermined second region of the liquid crystal display panel to first pixel electrode potential while fixing a potential of common electrode to a first common electrode potential when scanning the second region (first step); for one or more frames period after the one frame period , applying the voltage corresponding to the image data to the pixel electrodes in the first region when scanning the first region, and fixing the potential of the pixel electrodes in the second region to the first pixel electrode potential while fixing the potential of the common electrode to the first common electrode potential without scanning the second region (second step); for one frame period after the one or more frames period, applying the voltage corresponding to the image data to the pixel electrodes in the first region when scanning the first region, and fixing the potential of the pixel electrodes in the second region to a second pixel electrode potential different from the first pixel electrode potential while fixing the potential of the common electrode to a second common electrode potential different from the first common electrode potential when scanning the second region (third step); and next one or more frames period, applying the voltage corresponding to the image data to the pixel electrodes in the first region when scanning the first region, and fixing the potential of the pixel electrode in the second region to the second pixel electrode potential while the potential of the common electrode to the second common electrode potential without scanning the second region (fourth step); wherein a difference between the first and second common electrode potentials and a difference between the first and second pixel electrodes coincide with each other.

By the way, the number of frames at the step of fixing the potential of the common electrode to the first common electrode potential without scanning the second region and meanwhile continuing to fix the potential of the pixel electrode within the second region to the first pixel electrode potential may coincide with the number of frames at the step of fixing the potential of the common electrode to the second common electrode potential without scanning the second region and meanwhile continuing to fix the potential of the pixel electrode within the second region to the second pixel electrode potential.

Also, a switching cycle between a process composed of the step of scanning the second region and meanwhile fixing the potential of the common electrode to the first common electrode potential and further continuing to fix the potential of the pixel electrode within the second region to the first pixel electrode potential and the step of fixing the potential of the common electrode to the first common electrode potential without scanning the second region and further continuing to fix the potential of the pixel electrode within the second region to the first pixel electrode potential and a process composed of the step of scanning the second region and meanwhile fixing the potential of the common electrode to the second common electrode potential and further continuing to fix the potential of the pixel electrode within the second region to the second pixel electrode potential and the step of fixing the potential of the common electrode to the second common electrode potential without scanning the second region and further continuing to fix the potential of the pixel electrode within the second region to the second pixel electrode potential is desired to be approximately t (t is a natural number) seconds, and a value of the t is, for example, 1.

Another method of driving a liquid crystal display according to the present invention comprising the steps of: for one or more frames period, applying a voltage corresponding to an image data to pixel electrodes in a predetermined first region of a liquid crystal display panel while scanning the first region, and fixing a potential of a pixel electrodes in a predetermined second region of the liquid crystal display panel to a first pixel electrode potential while fixing a potential of a common electrode to a first common electrode potential when scanning the second region (first step); and next one or more frames period, applying the voltage corresponding to the image data to the pixel electrodes in the first region when scanning the first region, and fixing the potential of the pixel electrodes in the second region to a second pixel electrodes potential different from the first pixel electrodes potential while fixing the potential of the common electrode to a second common electrode potential different from the first common electrode potential when scanning the second region (second step); wherein a difference between the first and second common electrode potentials and a difference between the first and second pixel electrodes coincide with each other.

At this time, the number of frames at the step of scanning the second region, and meanwhile fixing the potential of the common electrode to the first common electrode potential, and further continuing to fix the potential of the pixel electrode within the second region to the first pixel electrode potential may coincide with the number of frames at the step of scanning the second region, and meanwhile fixing the potential of the common electrode to the second common electrode potential, and further continuing to fix the potential of the pixel electrode within the second region to the second pixel electrode potential.

Also, a switching cycle between the step of scanning the second region and meanwhile fixing the potential of the common electrode to the first common electrode potential and further continuing to fix the potential of the pixel electrode within the second region to the first pixel electrode potential and the step of scanning the second region and meanwhile fixing the potential of the common electrode to the second common electrode potential and further continuing to fix the potential of the pixel electrode within the second region to the second pixel electrode potential is desired to be approximately t (t is a natural number) seconds, and a value of the t is, for example, 1.

The first common electrode potential and the first pixel electrode potential may be approximately equal to each other, and the second common electrode potential and the second pixel electrode potential may be approximately equal to each other.

In the present invention, in the second region in which the indication is not carried out, a frame frequency of the voltage applied to the liquid crystal is made lower, and the change of the polarity is reduced. Moreover, the scanning itself in the second region is not carried out in the certain period. Thus, the electric power required to charge and discharge the gate line is largely reduced to thereby reduce the electric power consumption. Moreover, in the second region, the substantially alternating voltage is applied to the liquid crystal. Hence, the deterioration in the picture quality such as sticking and the like is prevented.

Moreover, when the voltages of the common electrode and the pixel electrode in each pixel are substantially equal to each other, the electric power associated with the operation for charging and discharging the data line is not substantially consumed.

DETAILED DESCRIPTION OF THE PREFERRED EMBODIMENT

Figure 1:
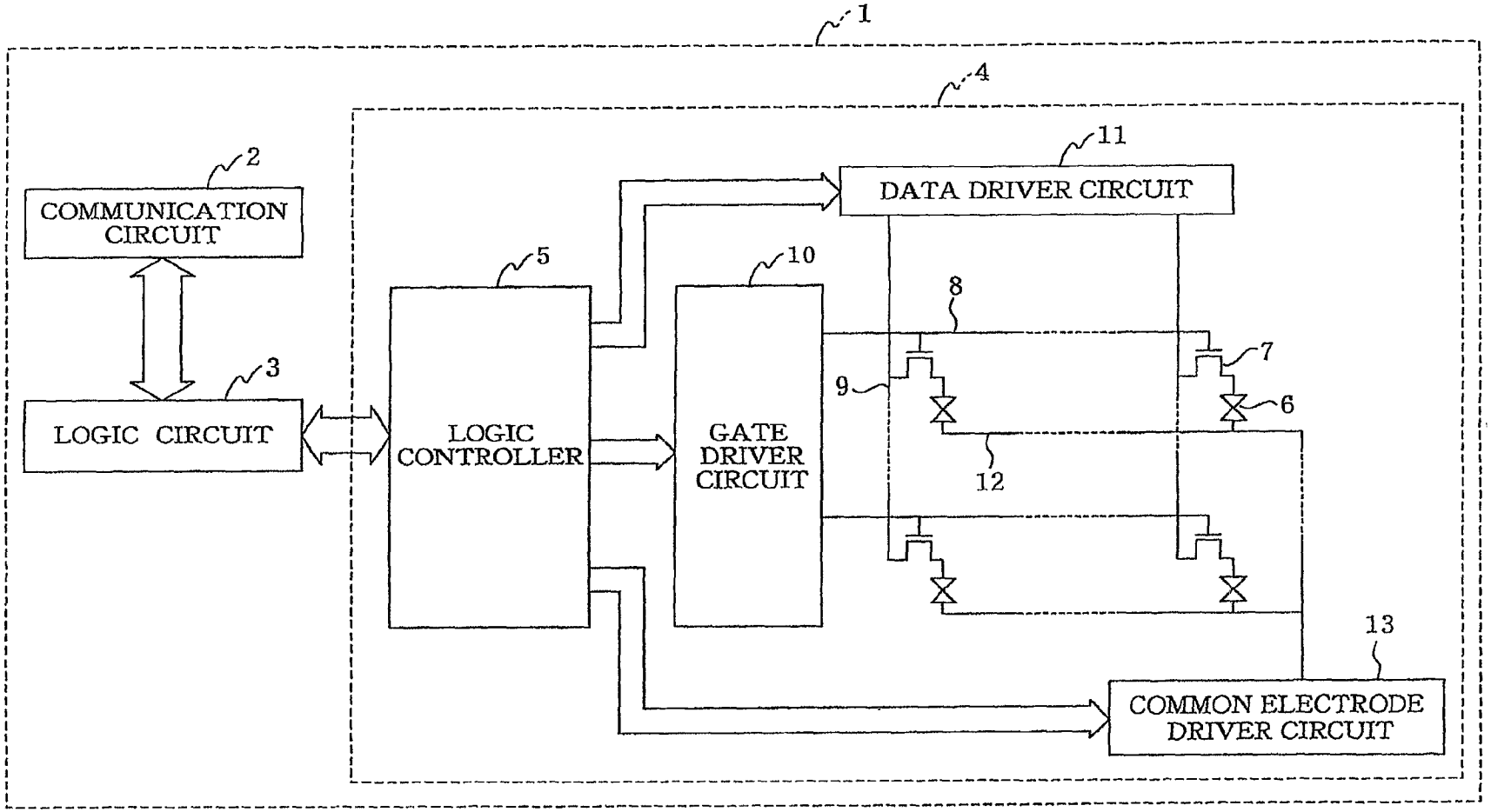
FIG. 1 is a block diagram showing a configuration of a portable telephone having LCD according to an embodiment of the present invention.

A method of driving LCD according to an embodiment of the present invention will be explained below with reference to the attached drawings. FIG. 1 is a block diagram showing the configuration of a portable telephone having the LCD according to the embodiment of the present invention.

The portable telephone 1 is provided with: a communication circuit 2 for transmission/reception of a call and a data to/from a base station; a logic circuit 3 for processing an inner digital data; and an LCD 4 according to the embodiment of the present invention serving as a display. The LCD 4 is composed of: a logic controller 5 for supplying/receiving a signal to/from the logic circuit 3; liquid crystal pixels 6; thin film field effect transistors (TFTs) 7 serving as switches to apply voltages to the liquid crystal pixels 6; gate lines 8 for applying signals to select the TFT 7; data lines 9 for applying voltages to the liquid crystal pixels 6; a gate driver circuit 10 for applying a voltage to the gate lines 8; a data driver circuit 11 for applying a voltage to the liquid crystal pixels 6 through the data lines 9; a common electrode 12 for supplying a signal for driving the liquid crystal pixel 6; and a common electrode driver circuit 13 for supplying a signal to the common electrode 12. The liquid crystal pixels 6 are arrayed in a shape of a matrix composed of m columns and n rows.

The operation of the portable telephone 1 having the above-mentioned configuration will be described below.

In this embodiment, the logic circuit 3 generates a command to instruct the LCD 4 to be operated at a low electric power consumption mode. If this command is inputted to the logic controller 5, the logic controller 5 outputs a signal for the low electric power consumption mode to the gate driver circuit 10, the data driver circuit 11 and the common electrode driver circuit 13, respectively. Accordingly, the operations of the gate driver 10, the data driver 11 and the common electrode driver 13 proceed to the low electric power consumption mode.

Figure 2:
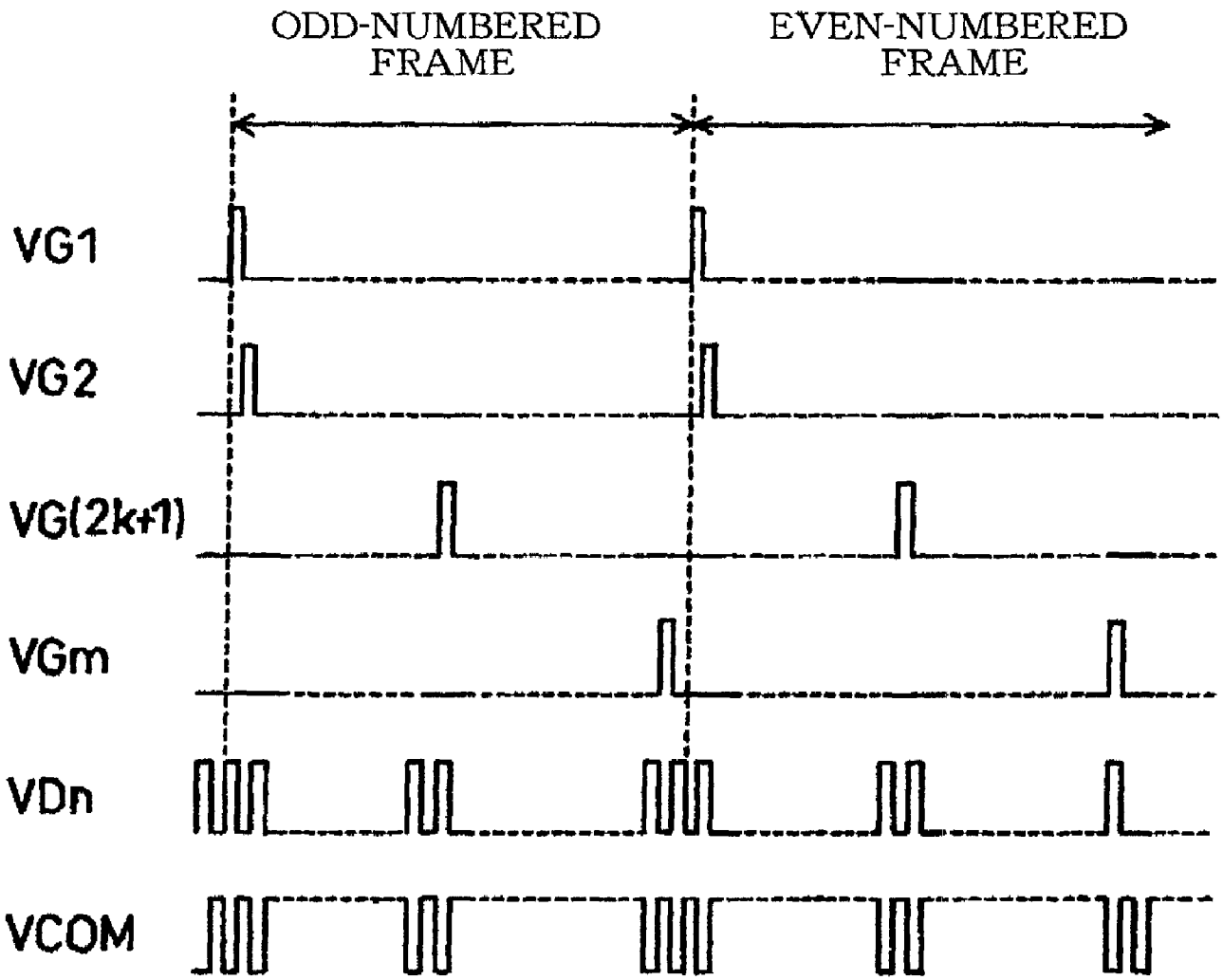
FIG. 2 is a timing chart showing an operation at a usual mode of a portable telephone 1.
Figure 3:
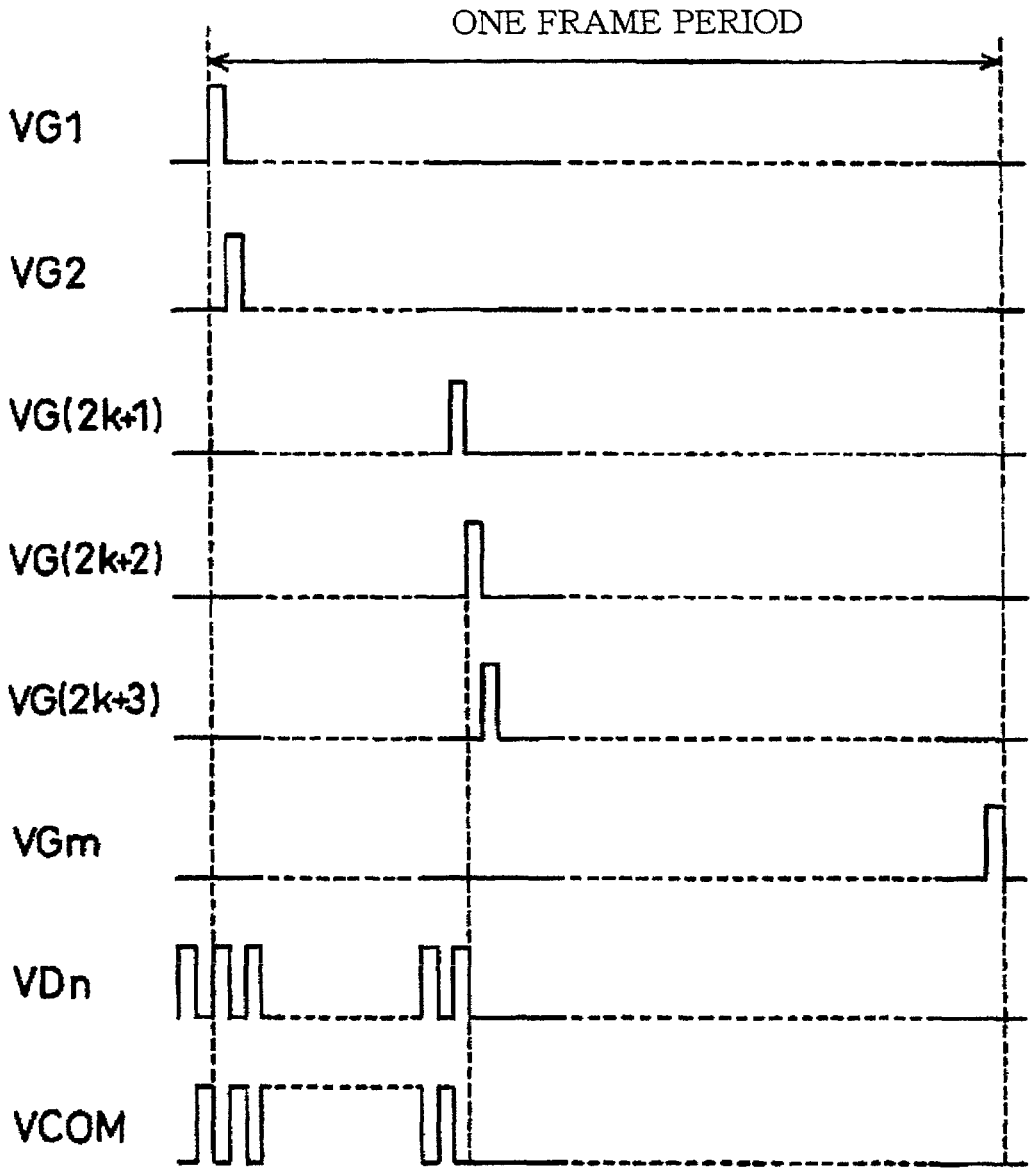
FIG. 3 is a timing chart showing an operation in a first period at a low electric power consumption mode of the portable telephone 1.
Figure 4:
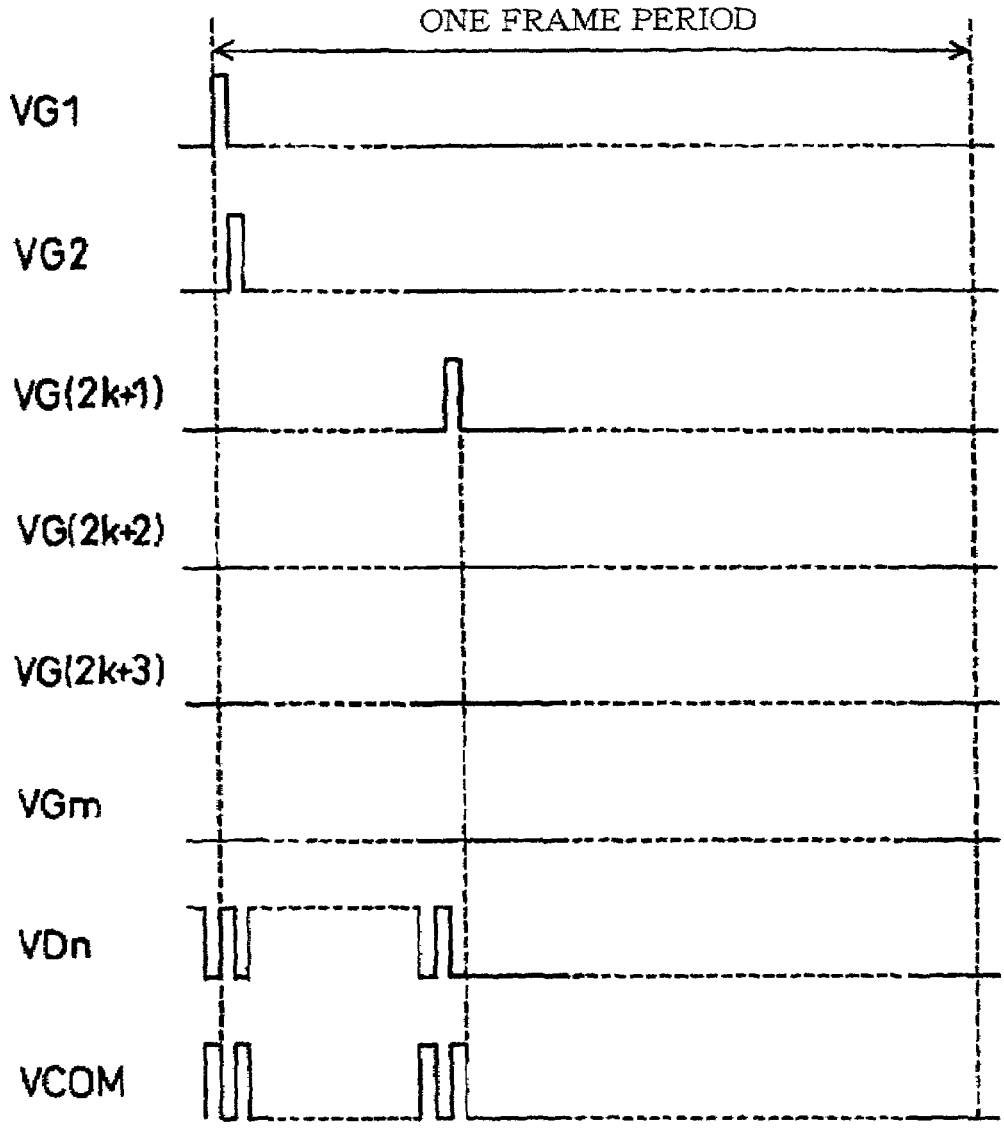
FIG. 4 is a timing chart showing an operation in a second period at the low electric power consumption mode of the portable telephone 1.
Figure 5:
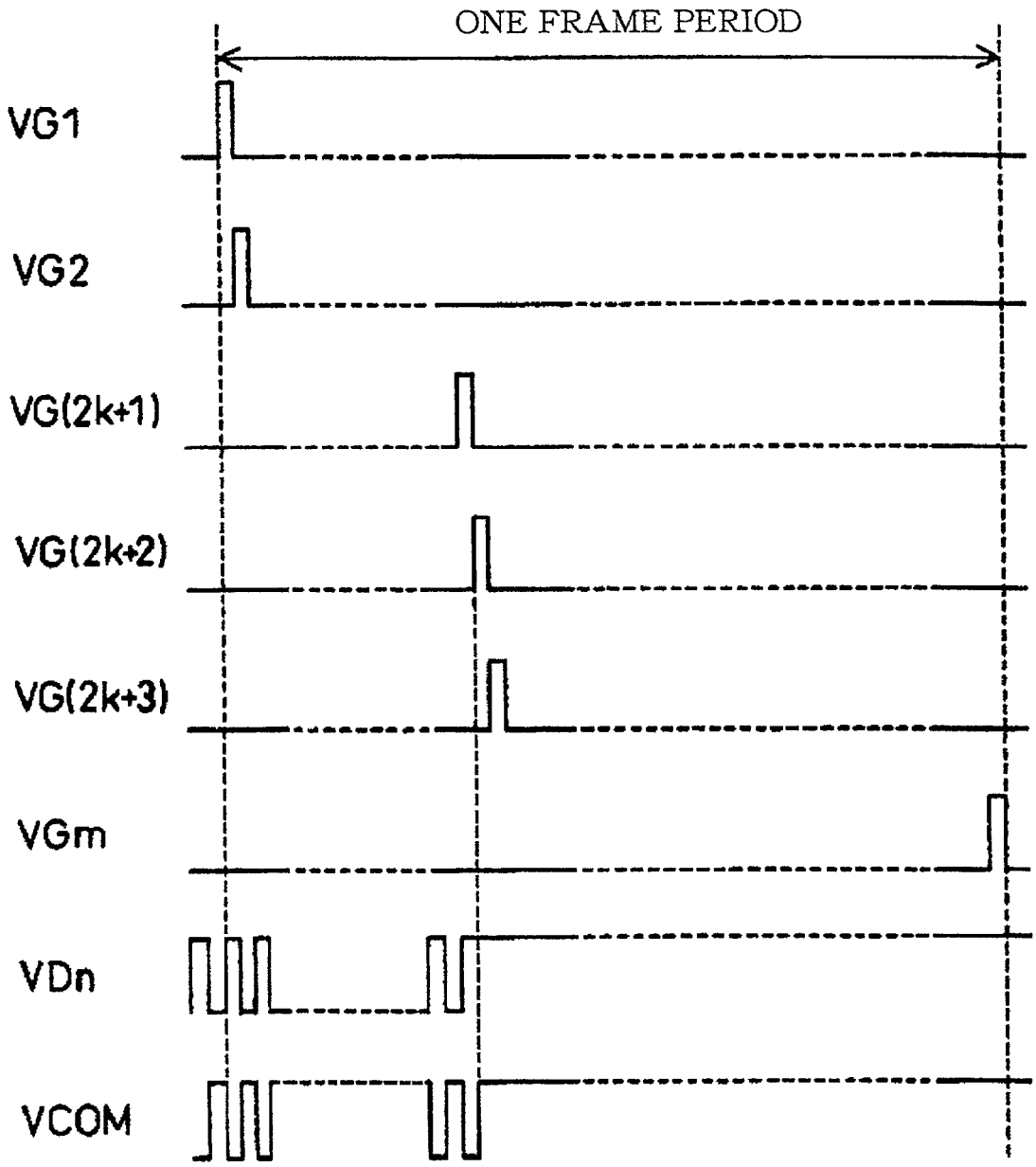
FIG. 5 is a timing chart showing an operation in a third period at the low electric power consumption mode of the portable telephone 1.
Figure 6:
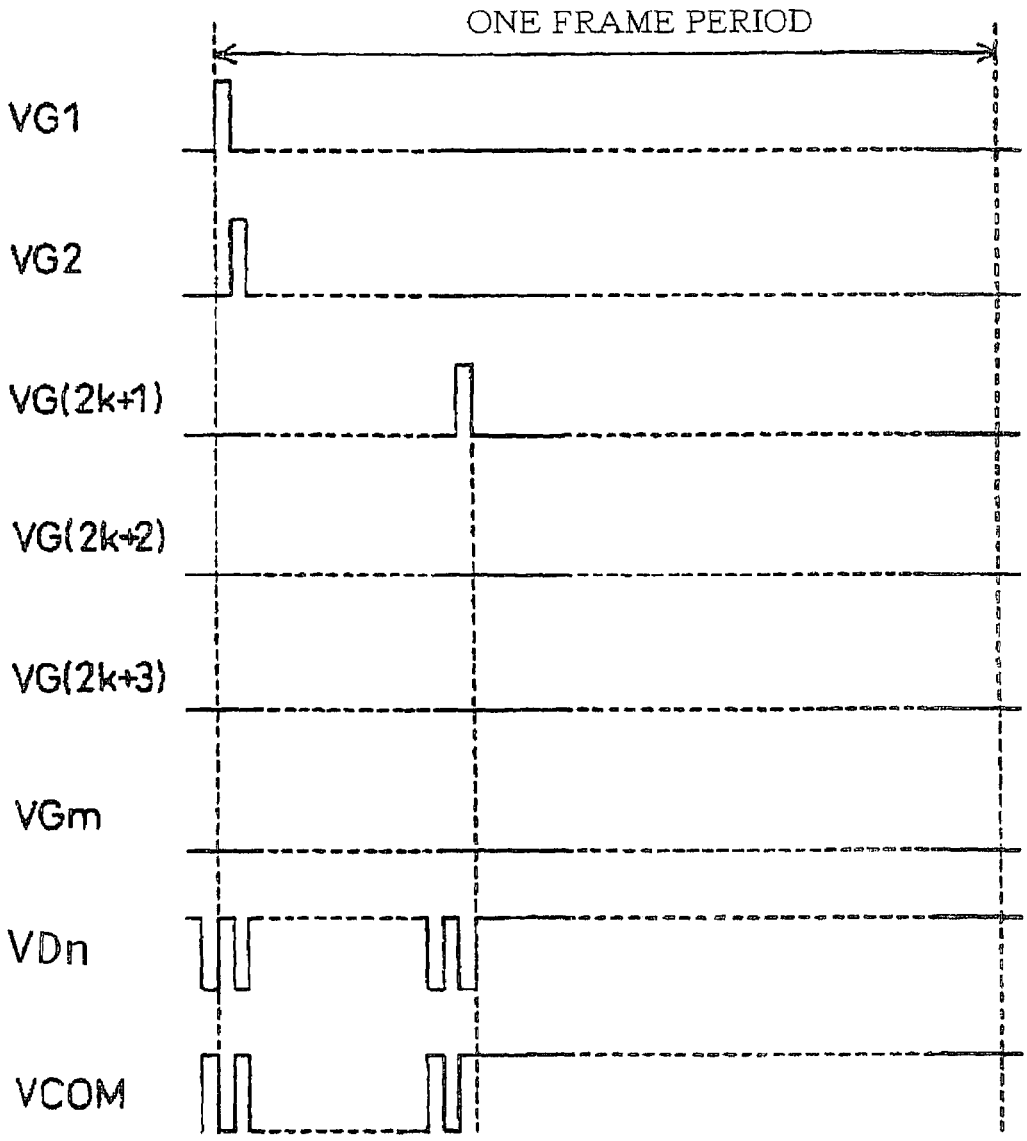
FIG. 6 is a timing chart showing an operation in a fourth period at the low electric power consumption mode of the portable telephone 1.
Figure 7:
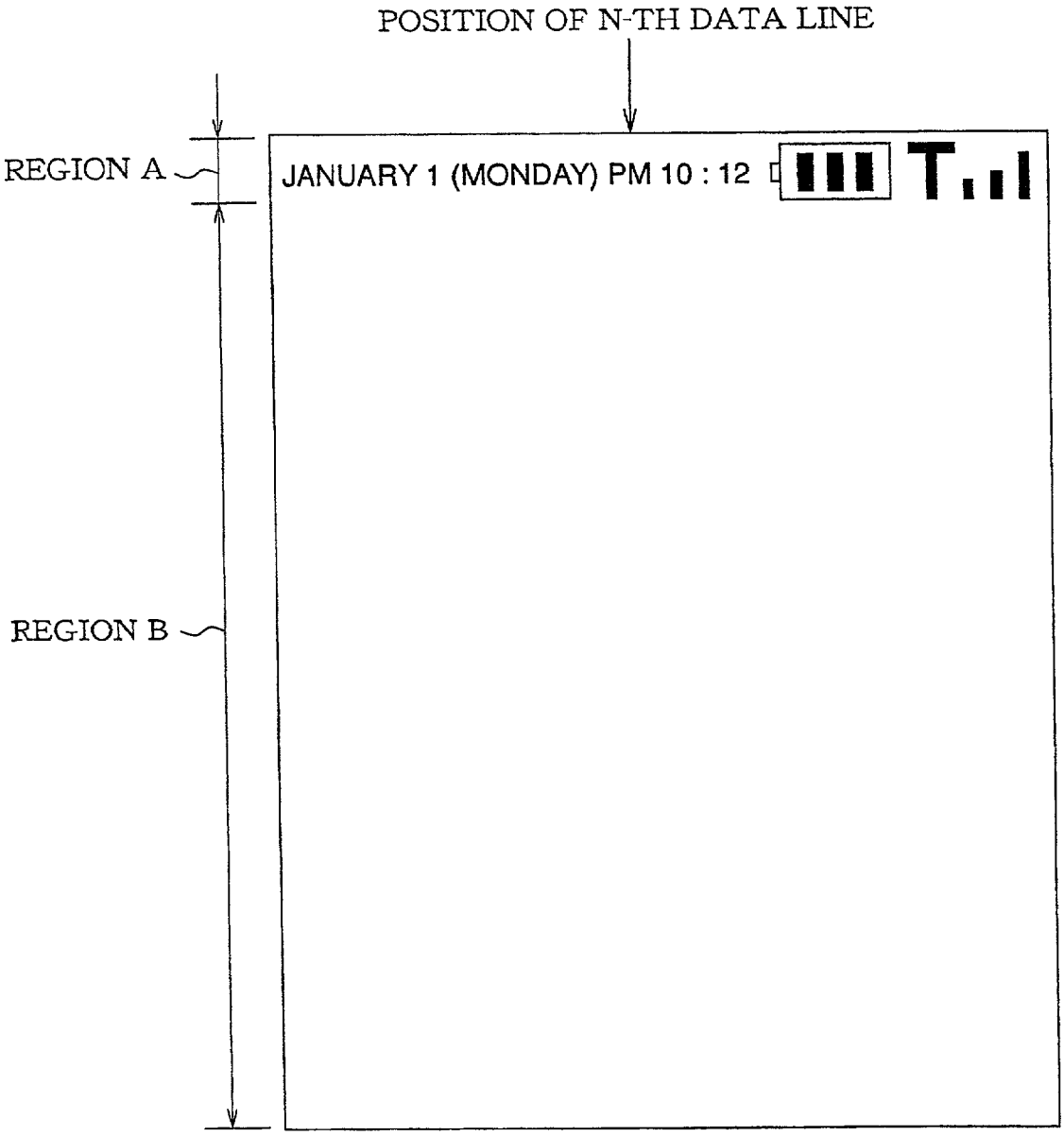
FIG. 7 is a chemetic view showing an indication at the low electric power consumption mode of the portable telephone 1.

FIG. 2 is a timing chart showing an operation at a usual mode of the portable telephone 1. FIG. 3 is a timing chart showing an operation in a first period at the low electric power consumption mode of the portable telephone 1. FIG. 4 is a timing chart showing an operation in a second period at the low electric power consumption mode of the portable telephone 1. FIG. 5 is a timing chart showing an operation in a third period at the low electric power consumption mode of the portable telephone 1. FIG. 6 is a timing chart showing an operation in a fourth period at the low electric power consumption mode of the portable telephone 1. And, FIG. 7 is a schematic view showing an indication at the low electric power consumption mode of the portable telephone 1. By the way, in FIGS. 2 to 6, [VG1] represents a signal of a first gate line from the top, [VG(2k+1)] represents a signal of a (2k+1)-th gate line from the top, and [VGm] represents a signal of an m-th gate line from the top, namely, a signal of a gate line located at the bottom. Also, [VDn] represents a signal of an n-th data line from the left, and [VCOM] represents a signal of the common electrode. k is an integer of 0 or more, and m and n are natural numbers.

At a usual mode, as shown in FIG. 2, polarities of the signals VDn and VCOM are set to be opposite to each other, and they are inverted each time one gate line 8 is selected. Also, with regard to each gate line 8, the polarities of the signals VDn and VCOM are set to be opposite by each frame, respectively. In short, when a signal VGk is set high in an odd-numbered frame with regard to the k-th gate line from the top, if the high signal VDn and the low signal VCOM are sent, the low signal VDn and the high signal VCOM are sent if the signal VGk is set high in an even-numbered frame. Then, such an operation is repeated in each frame period.

At the low electric power consumption mode, the signal of FIG. 3 is supplied for one frame period, then the signal of FIG. 4 is supplied for C, then the signal of FIG. 5 is supplied for one frame period, and the signal of FIG. 6 is supplied for x frames period are repeated to thereby carry out an indication only within a region A constituted by the liquid crystal pixels 6 connected to the gate lines until the (2k+1)-th gate line from the top, as shown in FIG. 7. Then, the indication is not performed at all in a region B constituted by the liquid crystal pixels 6 connected to the gate lines on and after the (2k+2)-th gate line from the top.

Actually, at a first frame (a first period) immediately after the low electric power consumption mode is started, as shown in FIG. 3, if the logic controller 5 recognizes the start of the low electric power consumption mode, within the region A, similarly to the usual mode shown in FIG. 2, the signals VDn and VCOM are sent to the gate lines 8 and the common electrode 12, respectively. Also, within the region B, the signals VDn and VCOM are fixed to, for example, the low level of the same potential (respectively, a first pixel electrode potential and a first common electrode potential) Thus, the polarities of the signals VDn and VCOM are not inverted even between the gate lines adjacent to each other.

In a period from a next frame to an x-th frame (a second period), the signal shown in FIG. 4 is repeatedly sent. At each frame in this period, as shown in FIG. 4, within the region A, similarly to the usual mode shown in FIG. 2, the signals VDn and VCOM are sent to the gate lines 8 and the common electrode 12, respectively. Also, within the region B, the signals VDn and VCOM are fixed to the low level, at each frame. Also, an output of a selection signal to the gate line 8 is stopped.

In a next one frame (a third period), as shown in FIG. 5, within the region A, similarly to the usual mode shown in FIG. 2, the signals VDn and VCOM are sent to the gate lines 8 and the common electrode 12, respectively. Also, within the region B, the signals VDn and VCOM are fixed to, for example, the high level of the same potential (respectively, a second pixel electrode potential and a second common electrode potential). Thus, the polarities of the signals VDn and VCOM are not inverted even between the gate lines adjacent to each other.

In a period from a next frame to an x-th frame (a fourth period), the signal shown in FIG. 6 is repeatedly sent. At each frame in this period, as shown in FIG. 6, within the region A, similarly to the usual mode shown in FIG. 2, the signals VDn and VCOM are supplied to the gate lines 8 and the common electrode 12, respectively. Also, within the region B, the signals VDn and VCOM are fixed to the high level, at each frame. Also, the output of the selection signal to the gate line 8 is stopped.

After that, the signals shown in FIGS. 3 to 6 continue being repeatedly supplied until the low electric power consumption mode is released. Then, if the low electric power consumption mode is released, the operation of the LCD returns back to the usual mode shown in FIG. 2.

According to such an embodiment, when a signal representative of the operation at the low electric power consumption mode is inputted to the LCD 4 from the external circuit (the logic circuit 3), the gate driver circuit 10 stops supplying the signal to the gate line 8 in the second and fourth periods, in the region B in which the indication is not done. Thus, the electric power required to charge and discharge the gate line 8 is largely reduced.

Also, in the region B, the common electrode driver 13 fixes the voltage of the common electrode 12 to the high level or the low level at each frame, and the data driver 11 outputs the voltage of the same level. Thus, the electric power associated with the operation for charging and discharging the data lines 8 is not substantially consumed.

Moreover, in the region B, a substantially alternating voltage is applied to the liquid crystal pixel 6, between the first and second periods and between the third and fourth periods. Thus, the deterioration in image quality, such as the sticking and the like, is not occur.

Thus, the electric power consumption can be reduced without any deterioration in the image quality of the LCD 4.

By the way, in the embodiment, the region A in which the indication is performed at the low electric power consumption mode is located on the uppermost portion of the LCD panel. However, the present invention is not limited to it. The region A may be installed at any position on the center, the lowermost portion or the like of the screen.

Also, in the embodiment, the region A is installed on one location within the screen. However, the present invention is not limited to it. The region A maybe installed at two or more locations.

Moreover, in the embodiment, the voltage difference is generated between both the electrodes of the liquid crystal pixel 6, in the region B. However, the present invention is not limited to it. A particular voltage different from the voltage of the common electrode 12 may continue being applied to the data line 9.

Furthermore, in the embodiment, the signals shown in FIGS. 5, 6 are applied after the application of the signals shown in FIGS. 3, 4, after the shift to the low electric power consumption mode is instructed. However, the signals shown in FIGS. 3, 4 may be applied after the application of the signals shown in FIGS. 5, 6, after the instruction of the shift.

Also, in the embodiment, the voltage of the same polarity is applied to the liquid crystal pixel 6 within the region A, from the first through second periods and from the third through fourth periods. However, the present invention is not limited to it. For example, the voltage whose polarity is inverted may be applied to the liquid crystal pixel 6 within the region A, between the first period and the second period. This is similar with regard to the relation between the third period and the fourth period.

Moreover, in the embodiment, the voltage of the same polarity continues being applied to the liquid crystal pixel 6 for the x frames within the region A, in the second and fourth periods. However, the present invention is not limited to it. The voltage whose polarity is inverted for each frame may be applied to the liquid crystal pixel 6 within the region A.

Furthermore, in the embodiment, in the region B, the voltage applied to the liquid crystal pixel 6 is inverted at a cycle of (x+1) frames. However, the present invention is not limited to it. The voltages applied to the data line 9 and the common electrode 12 may be made constant without any change.

Figure 8:
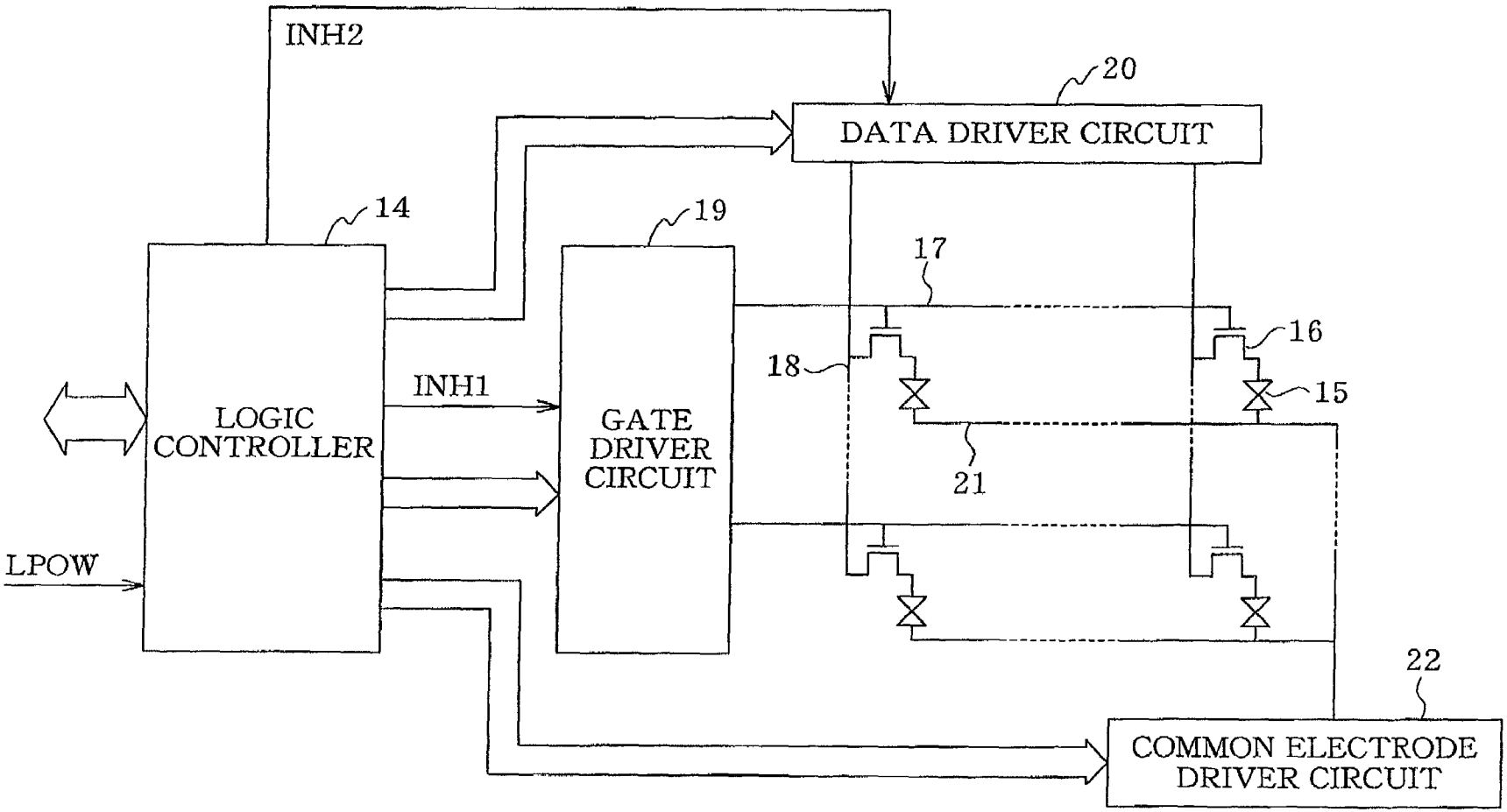
FIG. 8 is a block diagram showing a configuration of an active matrix LCD according to an embodiment of the present invention.

A detailed embodiment will be described below. FIG. 8 is a block diagram showing a configuration of an active matrix type LCD according to an embodiment of the present invention. The LCD according to this embodiment is used for a portable telephone. Its diagonal size is a 2 inch-type, the number of dots in a lateral direction is 120×RGB dots, and the number of dots in a longitudinal direction is 160 dots. Also, a frame frequency is 30 Hz, a mode of the liquid crystal is normally white, and the number of gradations is 6 bits in each of RGB. Moreover, the switching between the indications at the low electric power consumption mode is assumed to be carried out in a period of 60 frames. Thus, the switching between the indications at the low electric power consumption mode is carried out for each two seconds.

The LCD according to this embodiment is provided with: a logic controller 14 for supplying and receiving a signal to and from a logic circuit (not shown) in a portable telephone; liquid crystal pixels 15 having 120 (the number of rows in sub pixels)×160 (the number of columns)×3 (the number of colors); TFTs 16 serving as a switch to apply a voltage to the liquid crystal pixels 15; 160 gate lines 17 for applying a signal to select the TFT 16; 360 data lines 18 to supply a voltage to the liquid crystal pixels 15; a gate driver circuit 19 for applying a voltage to the gate lines 17; a data driver circuit 20 for applying a voltage through the data lines 18 to the liquid crystal pixels 15; a common electrode 21 for supplying a signal to drive the liquid crystal pixels 15; and a common electrode driver circuit 22 for supplying a signal to the common electrode 21. The liquid crystal pixels 15 are arrayed in a shape of a matrix composed of 160 columns and 360 rows.

Figure 9:
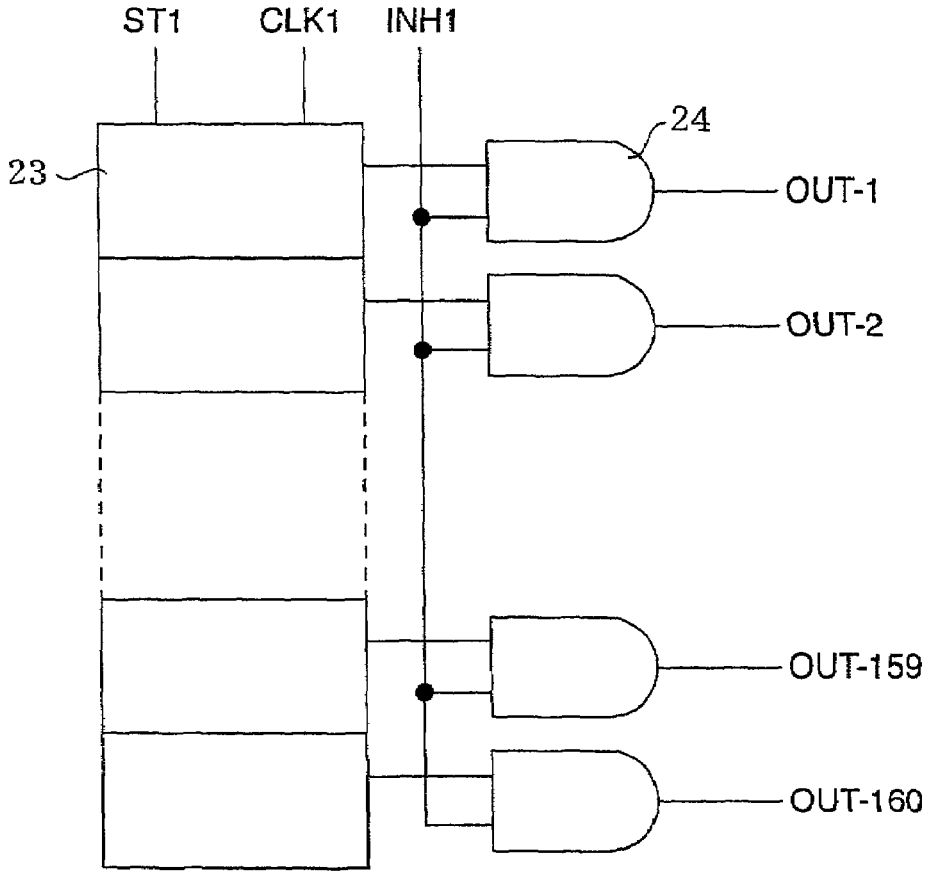
FIG. 9 is a block diagram showing a configuration of a gate driver 19.
Figure 10:
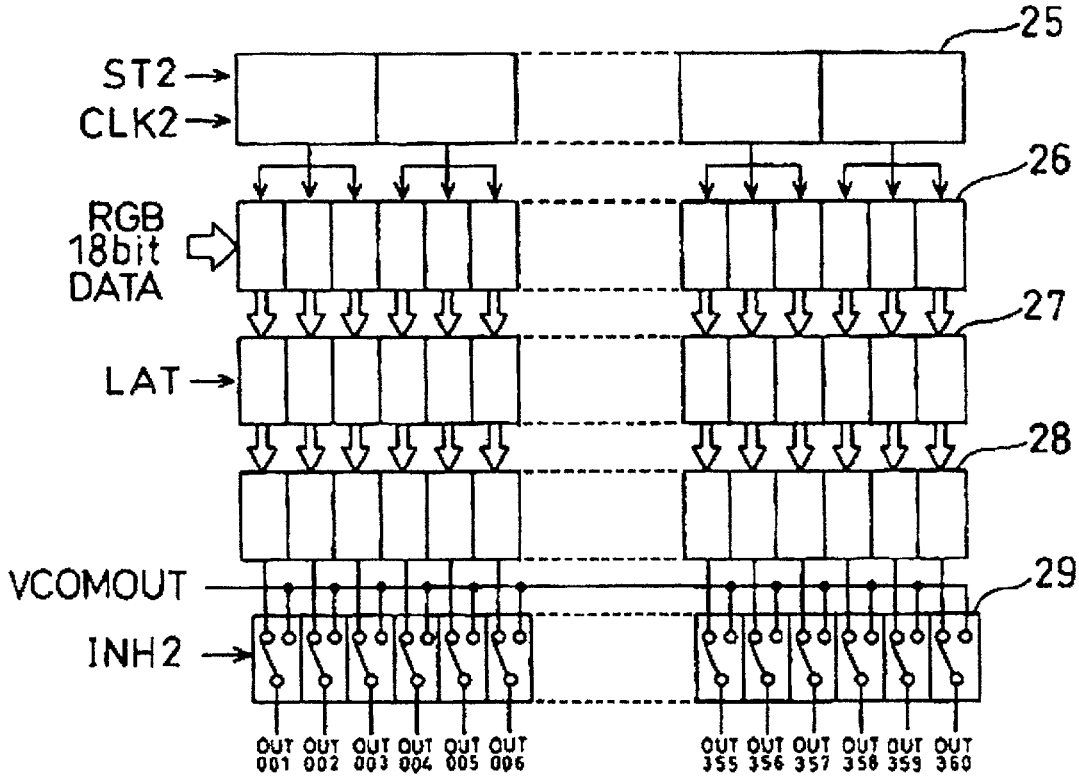
FIG. 10 is a block diagram showing a configuration of a data driver 20.
Figure 11:
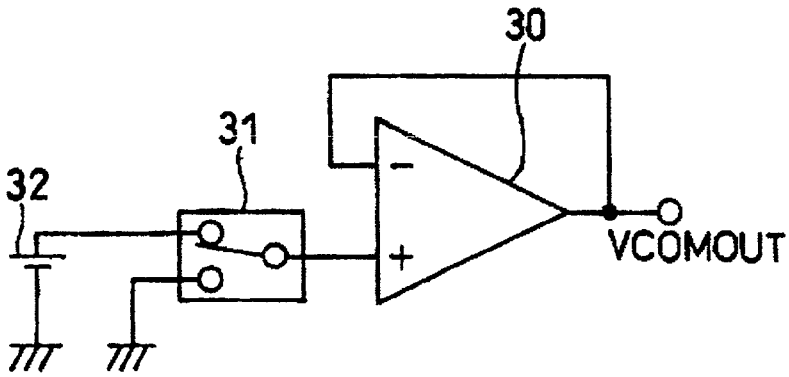
FIG. 11 is a block diagram showing a configuration of a common electrode driver 22.

FIG. 9 is a block diagram showing the configuration of the gate driver 19, FIG. 10 is a block diagram showing the configuration of the data driver circuit 20, and FIG. 11 is a block diagram showing the configuration of the common electrode driver circuit 22.

As shown in FIG. 9, the gate driver 19 having shift registers 23 of 160 stages; and two-input AND circuits 24, in which one input terminal is connected to each of the shift registers 23, for stopping outputs. A signal INH1 outputted from the logic controller 14 is inputted to the other input terminal of the AND circuit 24.

As shown in FIG. 10, the data driver circuit 20 having shift register circuits 25 of 120 stages; latch circuits 26 for storing data of a total of 18 bits of RGB inputted to blocks selected by the shift register circuits 25; line memories 27 for storing the data from the latch circuits 26 at one time; 360 digital/analog converters (DACS) 28 for converting a digital output from each of the line memories 27 into an analog signal supplied to each of the data lines 18; and 360 switches 29 for switching between an output voltage of each of the DACs 28 and a voltage applied at the low electric power consumption mode. The operation of each of the switches 29 is controlled by a signal INH2 outputted from the logic controller 14.

As shown in FIG. 11, the common electrode driver 22 is having a voltage follower 30 constituted by an operational amplifier; a switching circuit 31 for switching levels of the voltage of the common electrode 21; and a power source 32 for defining a high level of the voltage of the common electrode 21.

The operation of the LCD according to this embodiment having the above-mentioned configuration will be described below.

In this embodiment, when a command for instructing the LCD to be operated at the low electric power consumption mode is inputted from an external portion to the logic controller 14, the logic controller 14 outputs a signal for the low electric power consumption mode to the gate driver circuit 19, the data driver circuit 20 and the common electrode driver circuit 22, respectively. Then, the operations of the gate driver circuit 19, the data driver circuit 20 and the common electrode driver circuit 22 proceed to the operations of the low electric power consumption mode.

Figure 12:
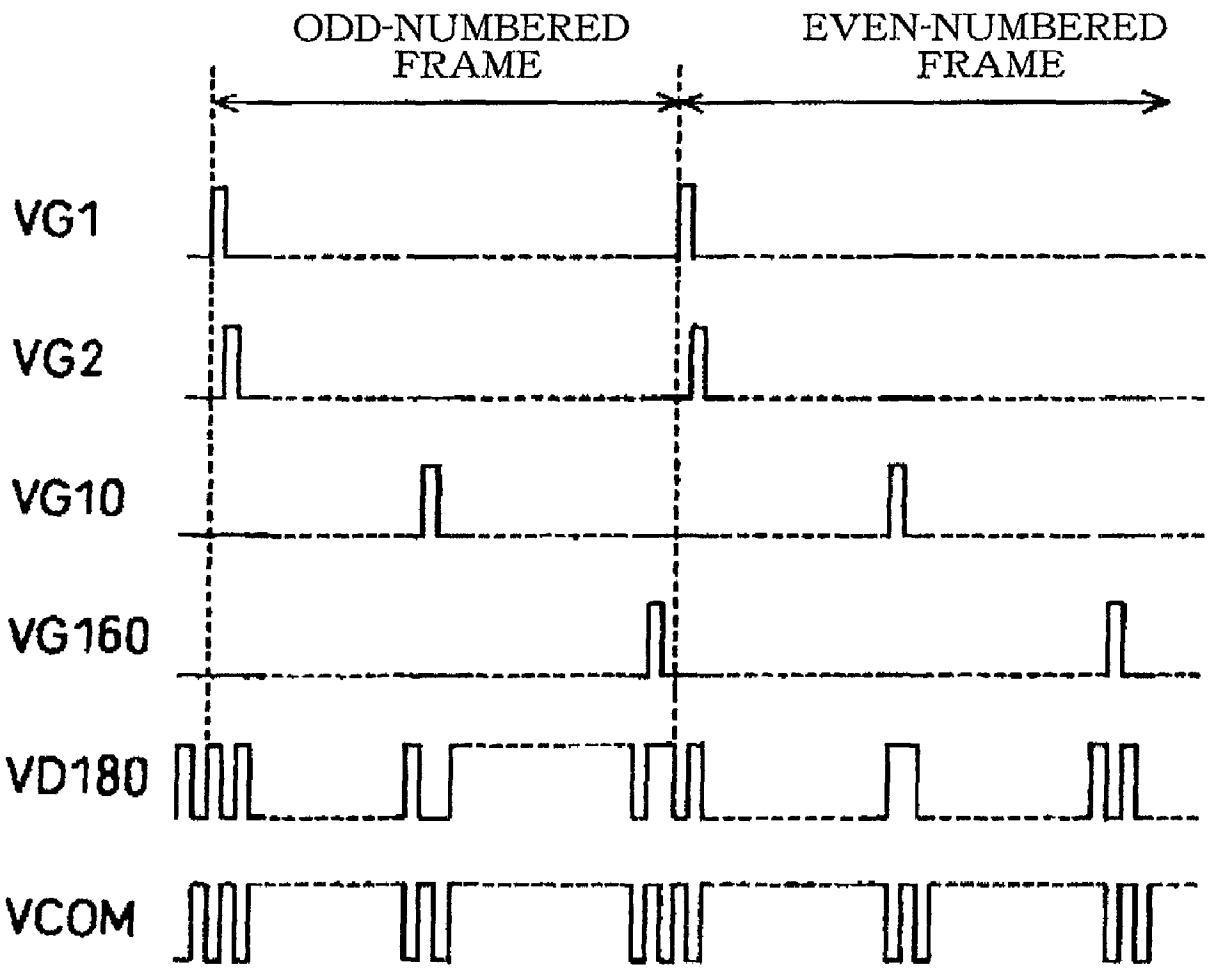
FIG. 12 is a timing chart showing an operation at a usual mode of LCD according to an embodiment of the present invention.
Figure 13:
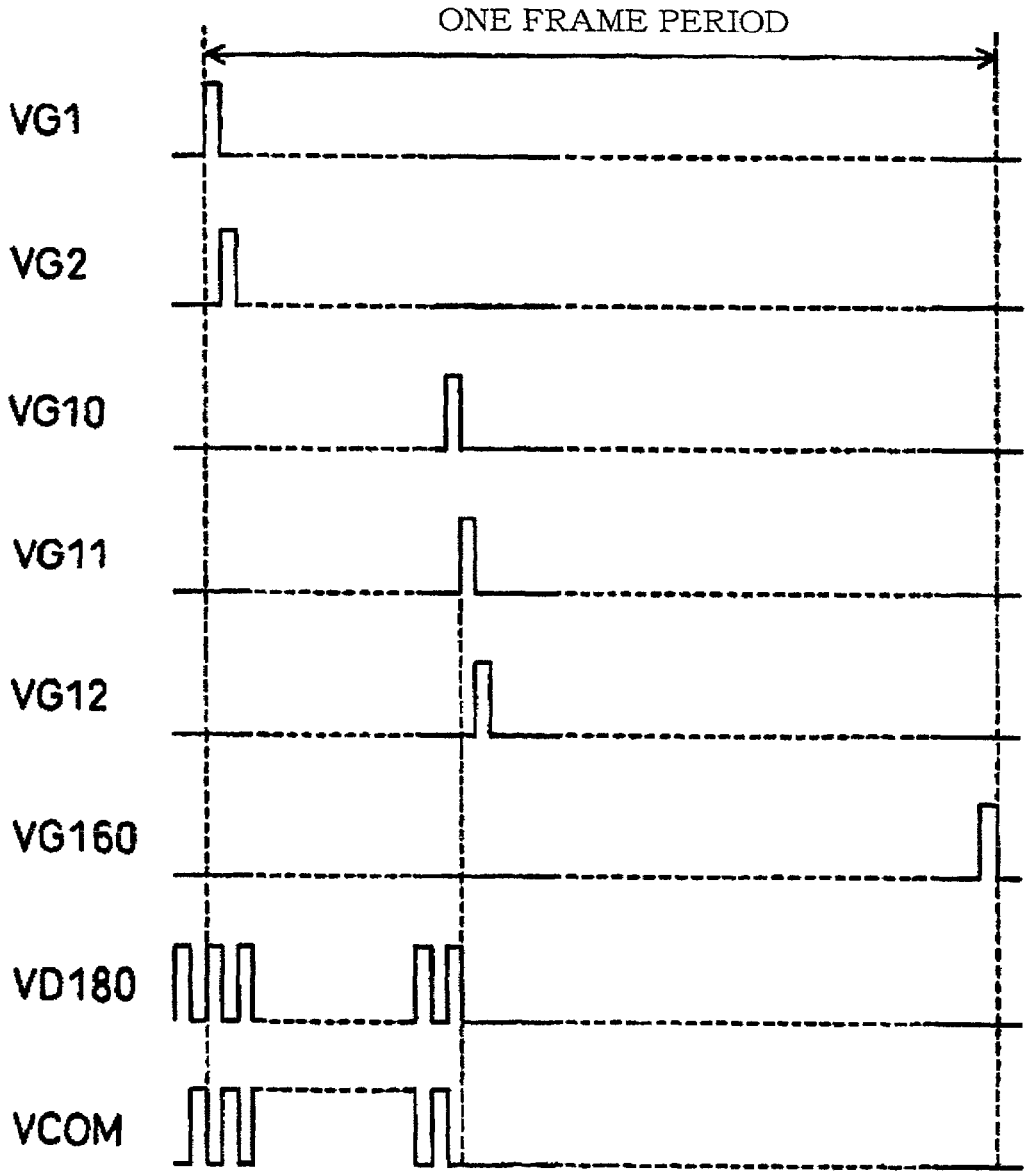
FIG. 13 is a timing chart showing an operation in a first period at a low electric power consumption mode of the LCD according to the embodiment of the present invention.
Figure 14:
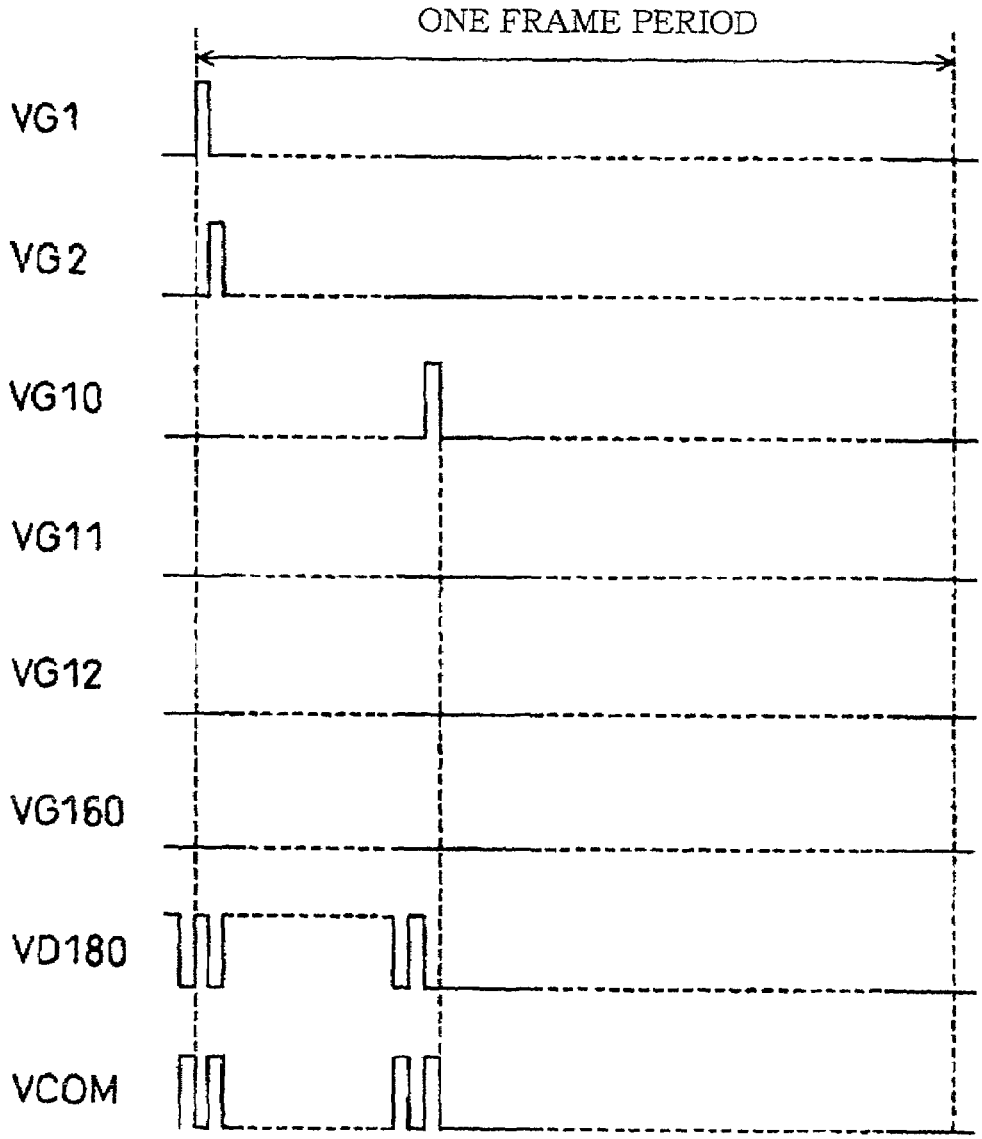
FIG. 14 is a timing chart showing an operation in a second period at the low electric power consumption mode of the LCD according to the embodiment of the present invention.
Figure 15:
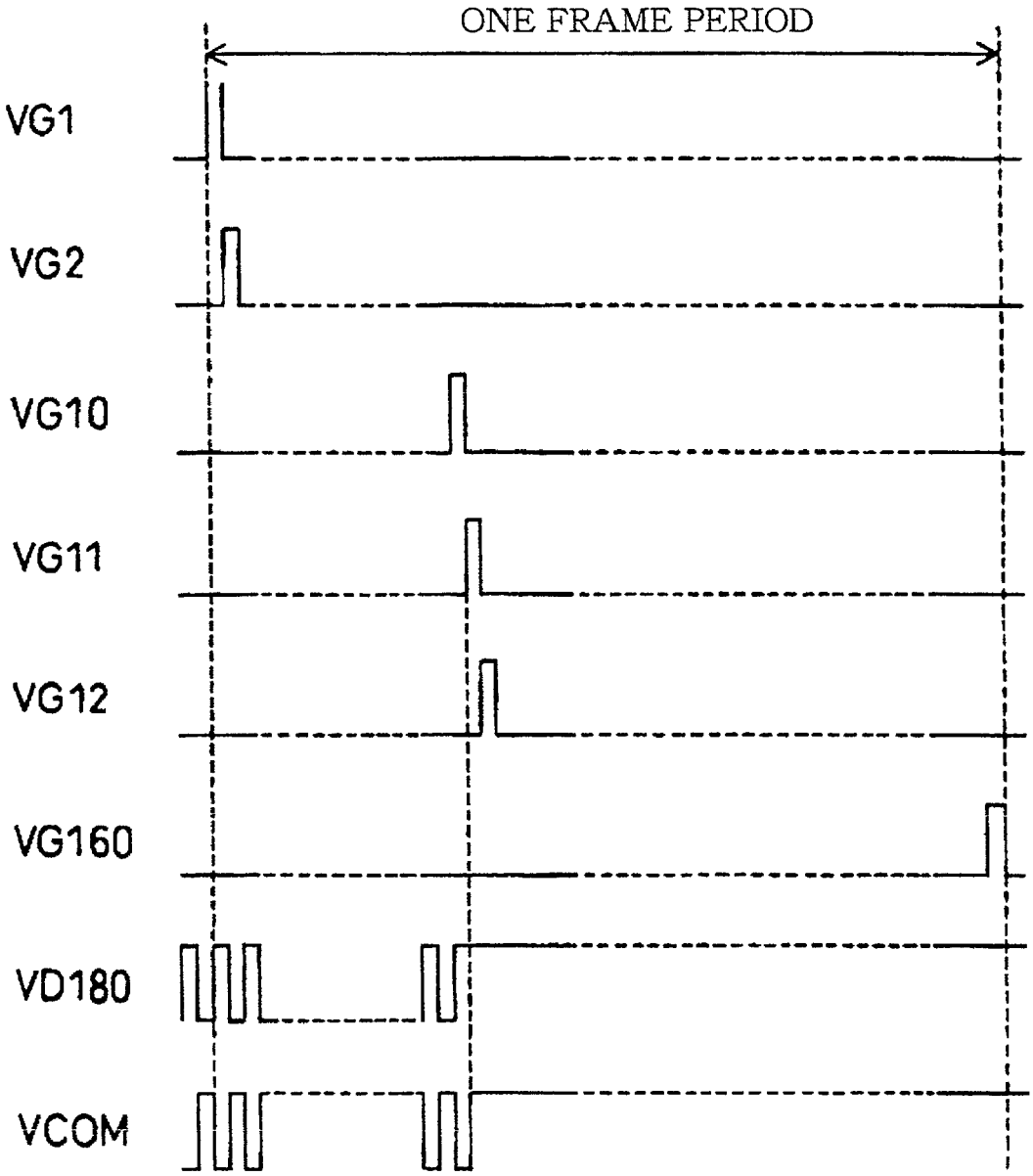
FIG. 15 is a timing chart showing an operation in a third period at the low electric power consumption mode of the LCD according to the embodiment of the present invention.
Figure 16:
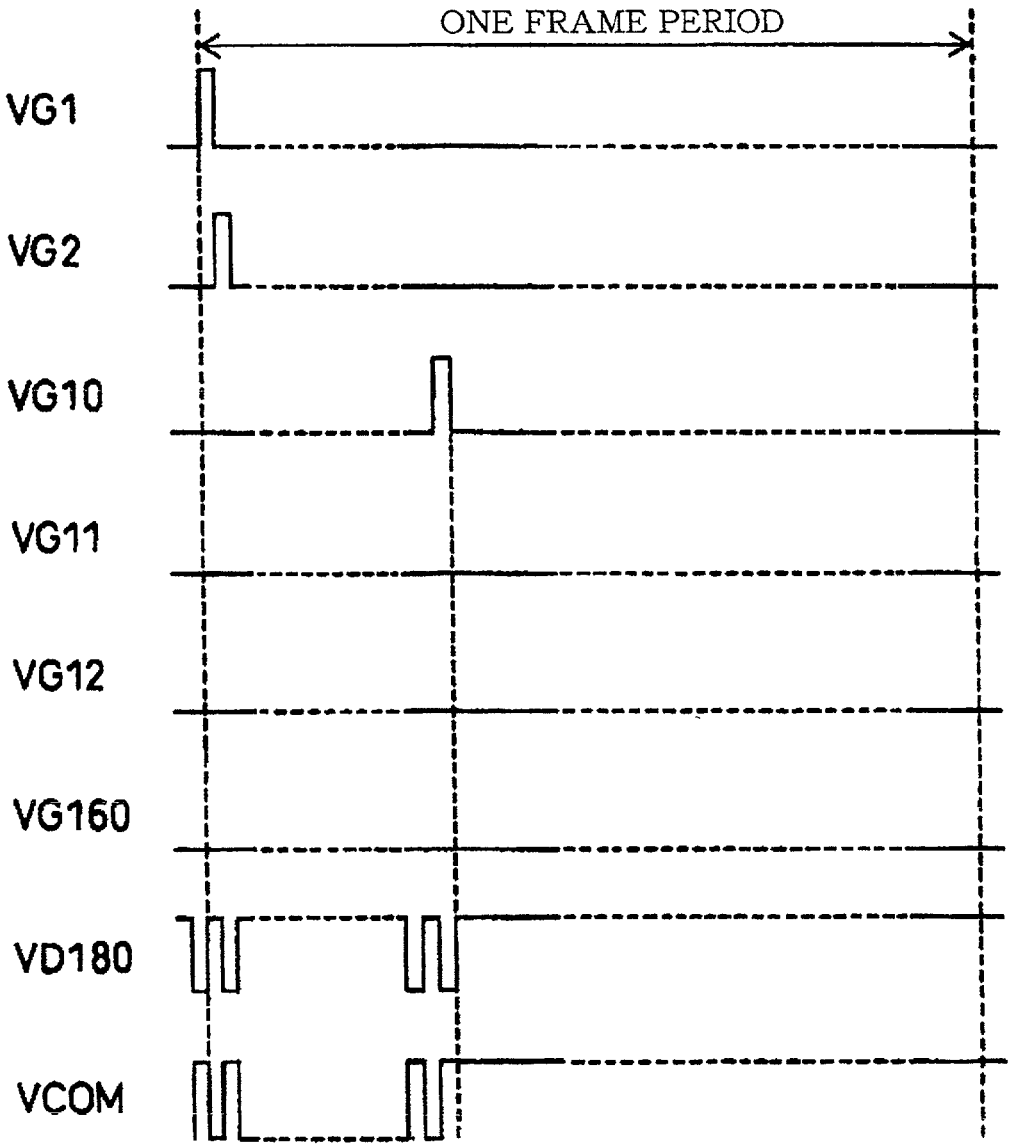
FIG. 16 is a timing chart showing an operation in a fourth period at the low electric power consumption mode of the LCD according to the embodiment of the present invention.
Figure 17:
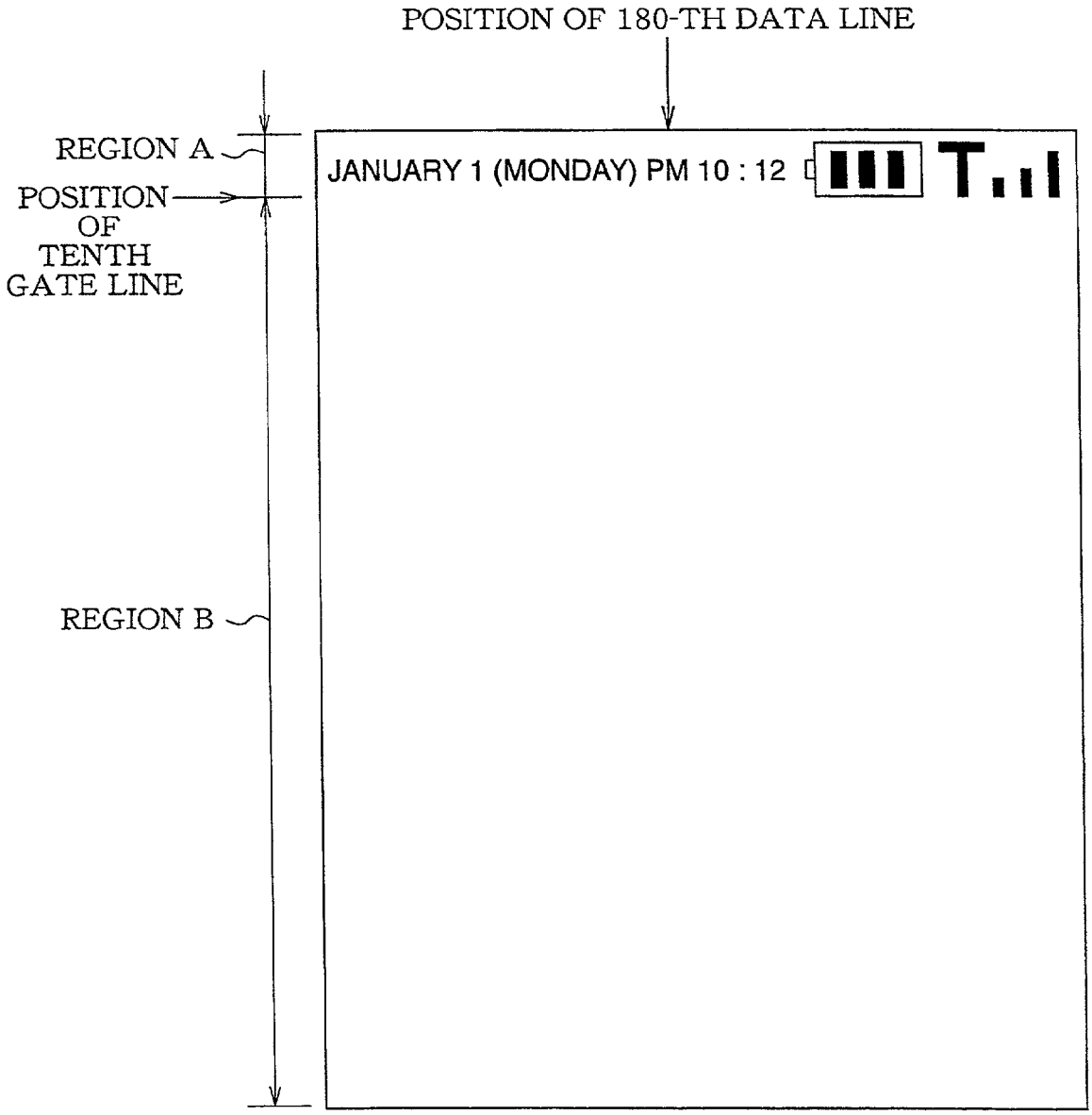
FIG. 17 is a s chematic view showing an indication at the low electric power consumption mode of the LCD according to the embodiment of the present invention.
Figure 18:
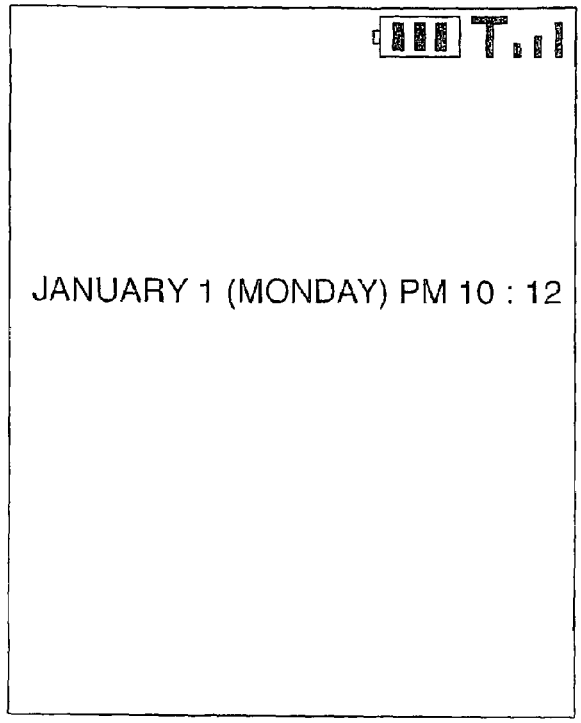
FIG.18 (PRIOR ART)
FIG. 18 is a schematic view showing an example of an indication at a wait state.
Figure 19:
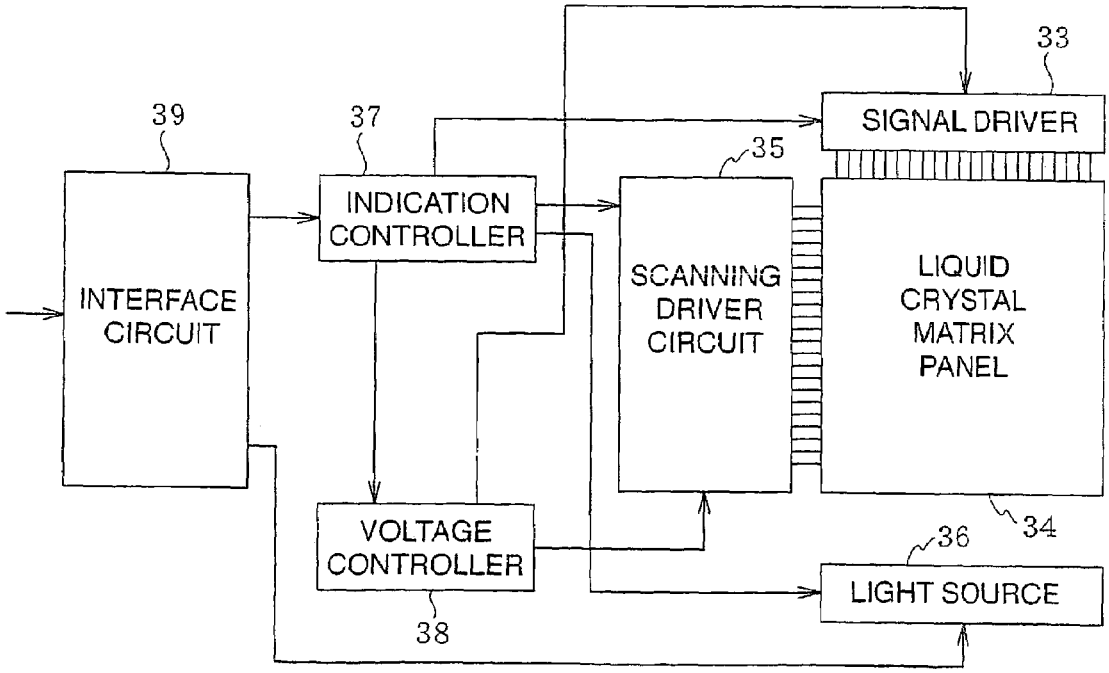
FIG.19 (PRIOR ART)
FIG. 19 is a block diagram showing a configuration of LCD similar to LCD disclosed in Japanese Laid Open Patent Application (JP-A-Heisei, 7-230077).

FIG. 12 is a timing chart showing an operation at a usual mode of the LCD according to the embodiment. FIG. 13 is a timing chart showing an operation in a first period at the low electric power consumption mode of the LCD according to the embodiment. FIG. 14 is a timing chart showing an operation in a second period at the low electric power consumption mode of the LCD according to the embodiment. FIG. 15 is a timing chart showing an operation in a third period at the low electric power consumption mode of the LCD according to the embodiment. FIG. 16 is a timing chart showing an operation in a fourth period at the low electric power consumption mode of the LCD according to the embodiment. And, FIG. 17 is a schematic view showing an indication at the low electric power consumption mode of the LCD according to the embodiment. By the way, in FIGS. 12 to 16, [VG1] represents a signal of a first gate line from the top. [VG2] represents a signal of a second gate line from the top. [VG10] represents a signal of a tenth gate line from the top. And, [VG160] represents a signal of a 160-th gate line from the top, namely, the gate line located at the bottom. Also, [VD 180] represents a signal of a 180-th data line from the left, and [VCOM] represents a signal of the common electrode.

At the time of the usual mode, as shown in FIG. 12, a signal LPOW for instructing the LCD to be operated at the low electric power consumption mode is set at a low level. Also, as for each of the gate lines 17, the polarities of the signals VDn and VCOM are set to be opposite by each frame, respectively. In short, when a signal VGk is set high at an odd-numbered frame with regard to the k-th gate line from the top, in the case of the supply of the high signal VDn and the low signal VCOM, the low signal VDn and the high signal VCOM are supplied if the signal VGk is set high in an even-numbered frame. Moreover, in the TFTS 16 connected to the same gate line, the polarities of the voltages applied to the pixel electrodes are set to be equal to each other, and the polarities of the voltages applied to the pixel electrode are inverted between the TFTs 16 connected to the gate lines adjacent to each other. In short, a so-called line inversion drive is employed.

Also, at the usual mode, it is assumed that the signals INH1, INH2 outputted from the logic controller 14 are both set at the high level. Thus, the output of the shift register 23 in the gate driver circuit 19 is outputted to the gate line 17 in its original state without any inversion. The output of the DAC 28 in the data driver circuit 20 is also outputted to the data line 18 in its original state.

At the low electric power consumption mode, a supply in one frame of a signal shown in FIG. 13, a supply in 29 frames of a signal shown in FIG. 14, a supply in one frame of a signal shown in FIG. 15 and a supply in 29 frames of a signal shown in FIG. 16 are repeated to thereby carry out an indication only within a region A constituted by the liquid crystal pixels 15 connected to the gate lines until the tenth gate line from the top, as shown in FIG. 17. Then, the indication is not done at all in a region B constituted by the liquid crystal pixels 16 connected to the gate lines on and after the eleventh gate line from the top. In short, the supply of the signal shown in FIG. 13 is performed in a (60×y+1)-th frame (a first period) after the LCD becomes at the low electric power consumption mode. The supply of the signal shown in FIG. 14 is performed in a second period from a (60×y+2)-th frame to a (60×y+30)-th frame. The supply of the signal shown in FIG. 15 is performed in a (60×y+31)-th frame (a third period). And, the supply of the signal shown in FIG. 16 is performed in a fourth period from a (60×y+32)-th frame to a (60×y+60)-th frame. The y is an integer of 0 or more. Also, a voltage is applied to both ends of the pixel electrode connected to the 180-th data line from the left in the region A.

Actually, when the signal LPOW is set at the high level, at the first frame immediately after that, the supply of the signal similar to the usual mode shown in FIG. 12 is performed within the region A, as shown in FIG. 13. On the other hand, the signals VCOM and VD180 are fixed to the low level, within the region B.

At this time, in the region A, let us suppose that the signals INH1, INH2 outputted from the logic controller 14 are both set at the high level. Thus, the output of the shift register 23 is outputted to the gate line 17 in its original state, and the output of the DAC 28 is outputted to the data line 18 in its original state, respectively. On the other hand, in the region B, it is assumed that although the signal INH1 is still kept at the high level, the signal INH2 is changed to the low level. Accordingly, the signal outputted to each of the data lines 18 is switched to the output voltage of the voltage follower 30 in the common electrode driver 22. Also, let us suppose that the switch 31 in the common electrode driver performed 22 is still connected to a ground implying the low level. As a result, the voltages of the common electrode 21 and the data line 18 are all fixed to the potential of the ground.

In a period from a next second frame to a 30th frame, the supply of the signal similar to the usual mode shown in FIG. 12 is performed within the region A, as shown in FIG. 14. On the other hand, within the region B, the signals VCOM and VD180 are fixed to the low level, similarly to the first frame. Also, the selection of the gate line 17 is stopped.

At this time, in the region A, the signals INH1, INH2 outputted from the logic controller 14 are both set at the high level. Thus, the output of the shift register 23 is outputted to the gate line 17 in its original state, and the output of the DAC 28 is outputted to the data line 18 in its original state, respectively. On the other hand, in the region B, it is assumed that the signal INH2 is still kept at the low level, and the signal INH1 is changed to the low level. As a result, similarly to the first frame, the voltages of the common electrode 21 and the data line 18 are all fixed to the potential of the ground, and the gate line 17 is not selected.

At a next 31th frame, the supply of the signal similar to the usual mode shown in FIG. 12 is performed within the region A, as shown in FIG. 15. On the other hand, within the region B, the signals VCOM and VD180 are fixed to the high level. As a result, the polarity of the voltage of the pixel electrode is inverted at each of the liquid crystal pixels 15.

At this time, in the region A, let us suppose that the signals INH1, INH2 outputted from the logic controller 14 are both set at the high level. Thus, the output of the shift register 23 is outputted to the gate line 17 in its original state, and the output of the DAC 28 is outputted to the data line 18 in its original state, respectively. On the other hand, in the region B, it is assumed that although the signal INH1 is still kept at the high level, the signal INH2 is changed to the low level. Accordingly, the signal outputted to each of the data line 18 is switched to the output voltage of the voltage follower 30. Also, the switch 31 is connected to the power supply 32, and it is set at a state that it is connected to the voltage of the high level. Thus, the voltages of the common electrode 21 and the data line 18 are all fixed to the potential of the high level.

In a period from a next 32th frame to a 60th frame, the supply of the signal similar to the usual mode shown in FIG. 12 is performed in the region A, as shown in FIG. 16. On the other hand, within the region B, the signals VCOM and VD180 are fixed to the high level, similarly to the 31th frame. Also, the selection of the gate line 17 is stopped.

At this time, in the region A, the signals INH1, INH2 outputted from the logic controller 14 are both set at the high level. Thus, the output of the shift register 23 is outputted to the gate line 17 in its original state, and the output of the DAC 28 is outputted to the data line 18 in its original state, respectively. On the other hand, in the region B, it is assumed that the signal INH2 is still kept at the low level, and the signal INH1 is changed to the low level. As a result, the voltages of the common electrode 21 and the data line 18 are all fixed to the potential of the ground, and the gate line 17 is not selected.

On and after the 61th frame, the signals shown in FIGS. 13 to 16 continue being repeatedly supplied until the low electric power consumption mode is released. Then, if the signal LPOW becomes at the high level and the low electric power consumption mode is released, the operation of the LCD returns back to the usual mode shown in FIG. 12.

By the way, the LCD in this embodiment is provided with the gate driver circuit 19, the data driver circuit 20 and the common electrode driver circuit 22. However, the present invention is not limited to it. Another configuration may be employed if the similar operation can be attained.

Also, it may be designed that the frame frequency and the switching cycle between the indications coincide with each other at the low electric power consumption mode, and the switching between the indications may be done for each second.

Moreover, in the above-mentioned embodiments, as shown in FIGS. 4, 6, 14 and 16, after each of the pulses shown in FIGS. 3, 5, 13 and 15 is applied to each of the electrodes in the one frame, the scanning is stopped in the region B in which the indication is not done in the one or more frames. However, the present invention is not limited to them. Each of the pulses shown in FIGS. 3, 5, 13 and 15 may be applied to each of the electrodes in the one or more frames, and the pulses shown in FIGS. 4, 6, 14 and 16 are not applied. That is, the scanning in the region B may be always carried out. Even at this time, the various parameters can be suitably changed similarly to the above-mentioned embodiments.

As detailed above, according to the present invention, in the second region, since the scanning is not performed in a certain period, the electric power required to charge and discharge the gate line can be largely reduced, which leads to the large reduction in the electric power consumption. Also, the alternating voltage is substantially applied to the liquid crystal. Thus, it is possible to prevent the deterioration in the image quality, such as the sticking and the like.

Moreover, when the voltages of the common electrode and the pixel electrode at each pixel are approximately equal to each other, it is possible to reduce the electric power consumption associated with the operation for charging and discharging the data line.

Furthermore, when it is assumed that even if an asymmetric voltage is applied to the pixel, the indication is changed over a long period of one second or more, it seems to be changed correspondingly to a second of a clock function in a case of an application to a portable telephone and the like. Thus, it is possible to prevent the recognition as the deterioration in the image quality.

The invention may be embodied in other specific forms without departing from the spirit or essential characteristic thereof. The present embodiments are therefore to be considered in all respects as illustrative and not restrictive, the scope of the invention being indicated by the appended Claims rather than by the foregoing description and all changes which come within the meaning and range of equivalency of the Claims are therefore intended to be embraced therein.

The entire disclosure of Japanese Patent Application No. 2001-170693 (Filed on Jun. 6, 2001) including specification, claims, drawings and summary are incorporated herein by reference in its entirety.

What is claimed is:

1. A method of driving a liquid crystal display comprising the steps of:

applying a voltage corresponding to an image data to pixel electrodes in a predetermined first region of a liquid crystal display panel when scanning the first region for one frame period, and fixing a potential of pixel electrodes in a predetermined second region of the liquid crystal display panel to first pixel electrode potential while fixing a potential of common electrode to a first common electrode potential when scanning the second region (first step);

for one or more frame periods after the one frame period, applying the voltage corresponding to the image data to the pixel electrodes in the first region when scanning the first region, and holding the potential of the pixel electrodes in the second region to the first pixel electrode potential while fixing the potential of the common electrode to the first common electrode potential without scanning the second region (second step);

for one frame period after the one or more frame periods, applying the voltage corresponding to the image data to the pixel electrodes in the first region when scanning the first region, and fixing the potential of the pixel electrodes in the second region to a second pixel electrode potential different from the first pixel electrode potential while fixing the potential of the common electrode to a second common electrode potential different from the first common electrode potential when scanning the second region (third step); and next one or more frame periods, applying the voltage corresponding to the image data to the pixel electrodes in the first region when scanning the first region, and holding the potential of the pixel electrodes in the second region to the second pixel electrode potential while fixing the potential of the common electrode to the second common electrode potential without scanning the second region (fourth step);

wherein a difference between the first and second common electrode potentials and a difference between the first and second pixel electrode potentials coincide with each other.

2. A method of driving a liquid crystal display according to claim 1, wherein the number of frames at the second step and the fourth step coincide with each other.

3. A method of driving a liquid crystal display according to claim 2, wherein a period including the first step and second step and a period including the third step and fourth step are switched by t (wherein symbol t is natural number) seconds cycle alternatively.

4. A method of driving a liquid crystal display comprising the steps of:

for one or more frame periods, applying a voltage corresponding to an image data to pixel electrodes in a predetermined first region of a liquid crystal display panel while scanning the first region, and fixing a potential of a pixel electrodes in a predetermined second region of the liquid crystal display panel to a first pixel electrode potential while fixing a potential of a common electrode to a first common electrode potential when scanning the second region (first step); and next one or more frame periods, applying voltage corresponding to the image data to the pixel electrodes in the first region when scanning the first region, and fixing the potential of the pixel electrodes in the second region to a second pixel electrodes potential different from the first pixel electrodes potential while fixing the potential of the common electrode to a second common electrode potential different from the first common electrode potential when scanning the second region (second step);

wherein a difference between the first and second common electrode potentials and a difference between the first and second pixel electrode potentials coincide with each other.

5. A method of driving a liquid crystal display according to claim 4, wherein the number of frames at the first step and the second step coincide with each other.

6. A method of driving a liquid crystal display according to claim 5, wherein the first step and the second step are switched by t (wherein symbol t is natural number) seconds cycle alternatively.

7. A method of driving a liquid crystal display according to claim 3, wherein a value of the t is 1.

8. A method of driving a liquid crystal display according to claim 6, wherein a value of the t is 1.

9. A method of driving a liquid crystal display according to claim 1, wherein the first common electrode potential and said first pixel electrode potential are equal to each other.

10. A method of driving a liquid crystal display according to claim 4, wherein the first common electrode potential and said first pixel electrode potential are equal to each other.

11. A method of driving a liquid crystal display according to claim 1, wherein said second common electrode potential and said second pixel electrode potential are equal to each other.

12. A method of driving a liquid crystal display according to claim 4, wherein said second common electrode potential and said second pixel electrode potential are equal to each other.

* * * * *